United States Patent [19]

Schulte

[11] 4,244,711

[45] Jan. 13, 1981

[54] PROCESS FOR MINIMIZING THE DEPOSITION OF MATERIALS IN THE AMMONIA LIQUOR COOLERS IN THE COKING OF CARBONACEOUS MATERIALS

[75] Inventor: Elwood V. Schulte, Pittsburgh, Pa.

[73] Assignee: Koppers Company, Inc., Pittsburgh, Pa.

[21] Appl. No.: 892,141

[22] Filed: Mar. 31, 1978

[51] Int. Cl.[3] ..... B01D 47/00

[52] U.S. Cl. ..... 55/89; 55/70; 55/73; 201/29; 585/861; 208/48 AA; 208/342

[58] Field of Search ..... 55/68, 49, 73, 70, 84, 55/85, 89, 93–95; 201/29, 30; 260/674 R, 674 N, 674 SE; 208/48 AA, 342; 585/861

[56] References Cited

U.S. PATENT DOCUMENTS

| | | | |
|---|---|---|---|
| 1,457,877 | 6/1923 | Doty | 55/70 |
| 1,578,687 | 3/1926 | Sperr, Sr. | 55/94 |
| 2,649,404 | 8/1953 | Reynolds | 260/674 R |
| 2,710,663 | 6/1955 | Wilson . | |
| 2,810,450 | 10/1957 | Hartmann . | |
| 3,000,693 | 9/1961 | Schulte . | |
| 3,020,138 | 2/1962 | Wethley | 55/94 |
| 3,342,723 | 9/1967 | Godar | 208/48 AA |
| 3,451,896 | 6/1969 | Schon | 201/29 |
| 3,581,472 | 6/1971 | Grosick | 55/94 |
| 3,607,047 | 9/1971 | Broom | 55/70 |
| 4,001,347 | 1/1977 | Gosick . | |
| 4,154,584 | 5/1979 | Ulrich | 55/89 |

OTHER PUBLICATIONS

Making, Shaping & Treating of Steel, sixth edition, 6/52, J. M. Camp, C. B. Francis, published by U. S. Steel, pp. 248–252.

Chemical Abstracts, vol. 80, 1974, No. 39137b.

*Primary Examiner*—Bernard Nozick

*Attorney, Agent, or Firm*—Donald M. MacKay

[57] ABSTRACT

A process is provided for minimizing the deposition of materials like naphthalene and tar in the ammonia liquor coolers of the primary cooler in a by-product recovery process for coking carbonaceous materials. The ammonia liquor coming from the primary cooler, wherein it is used to cool the coke oven gas, has added to it light oil before it reaches the ammonia liquor coolers, where it is cooled indirectly with water. The addition of the light oil keeps the naphthalene and tar in solution at the lower temperatures of the ammonia liquor coolers, thereby reducing or preventing the deposition of the naphthalene and tar in the ammonia liquor coolers.

6 Claims, 2 Drawing Figures

PROCESS FOR MINIMIZING THE DEPOSITION OF MATERIALS IN THE AMMONIA LIQUOR COOLERS IN THE COKING OF CARBONACEOUS MATERIALS

BACKGROUND OF THE INVENTION

The present invention relates to an improved process for reducing or preventing the deposition of materials in a heat exchanger. More particularly, the process of the present invention relates to an improved process for reducing or preventing the deposition of naphthalene and tar in the ammonia liquor coolers in a process for coking coal.

Coke oven gas produced in the coking process for coal is cooled to produce condensed products such as an aqueous solution containing ammonia, tar, and light oil. In addition, the coke oven gas contains fixed gases such as hydrogen, methane, ethane, carbon monoxide, carbon dioxide and some unsaturated hydrocarbons.

As the coke oven gas leaves the coke oven, it is initially cooled with flushing liquor. The flushing liquor is primarily the water condensed from previously cooled coke oven gas and it contains ammonium salts. This initial cooling causes the condensation of a relatively heavy tar from the coke oven gas. The heavy tar and flushing liquor enter a decanter tank for separation. The non-condensed gases and vapors remaining in the coke oven gas after initial contact with the flushing liquor is cooled further to around 95° F. (35° C.) to remove additional tar and a major portion of water vapor in either direct or indirect primary coolers.

In the direct type cooler the gas is contacted with condensed water vapor containing free ammonia, hereinafter referred to as ammonia liquor. As a result of this second cooling, heat and water are removed from the gas, thereby reducing its volume while light tar with some naphthalene is condensed along with a considerable quantity of weak liquor containing ammonia. The light tar and ammonia liquor condensates are processed either separately or mixed with the heavy tar and flushing liquor at the flushing liquor decanter tank. The cooled coke oven gas can be compressed and passed through a naphthalene scrubber for the removal of naphthalene in order to prevent naphthalene from separating out of the gas downstream of the naphthalene scrubber. When the gas is cooled to a fairly low temperature in the primary cooler, naphthalene separation from the gas becomes a problem. Naphthalene is a solid at atmospheric temperatures and is negligibly soluble in water. Pure naphthalene melts at 176° F. (80° C.) and boils at 424° F. (218° C.). A considerable quantity of naphthalene condenses after the coke oven gas leaves the coke oven battery and dissolves in the heavy tar in the initial cooling step. However, even though additional naphthalene dissolves in the light tar phase present in the primary cooler, it can cause trouble in the primary cooler and auxiliaries, such as the ammonia liquor coolers, further downstream in the process.

In the indirect type primary cooler the gas flows through the shell part of a shell-and-tube heat exchanger in the primary cooler. The gas is cooled as it indirectly contacts water flowing countercurrently in the tube part of the heat exchanger. The presence of naphthalene in the gas is a definite problem. Most of the tar from the gas is condensed in the first section of the hotter end of the heat exchanger. Consequently, there is no tar in the last section on the cold end of the heat exchanger for dissolving naphthalene. Because of this, it is general practice to have several indirect primary coolers in parallel and always have one extra cooler.

After the gas mixture leaves the primary cooler, the gas mixture may flow into and through an ammonia scrubber. Finally, the cooled and semi-cleaned gas may next pass through a light oil scrubber or washer where wash oil contacts the coke oven gas and removes light oil from the gas. Further downstream from the light oil scrubber, there can be located a gas desulfurization absorber to remove hydrogen sulfide from the coke oven gas. If most of the ammonia has not been removed from the coke oven gas upstream of the gas desulfurization absorber, such ammonia will collect with the acid gases which contain mostly hydrogen sulfide, along with some hydrogen cyanide and carbon dioxide. This collection could cause polymerization problems between hydrogen cyanide and ammonia if a substantial quantity of ammonia is present in the gas.

To obtain both efficient removal of naphthalene from the coke oven gas at the naphthalene scrubber and efficient removal of ammonia at the ammonia scrubber as well as efficient recovery of light oil, requires relatively low gas temperatures, hence the need for effective gas cooling at the primary coolers. This effective gas cooling is effected by circulating to an indirect cooler the heated ammonia liquor which has been separated from the condensed tar after being used to cool the coke oven gas. Then the cooled ammonia liquor is conveyed back to the primary cooler to cool more coke oven gas and condense more water vapor and light tar.

The amount of naphthalene produced in the carbonization step is usually sufficient to practically saturate the light tar collected in the primary cooler. Since the ammonia liquor removed from the primary cooler and conveyed through the indirect coolers still contains traces of light tar, the naphthalene in the light tar is caused to crystallize out of solution on the liquor side cooling surfaces of the indirect cooler, when the liquor is cooled to desirable temperature for recycle to the primary cooler. This deposition on the cooling surfaces impairs the cooling efficiency of the indirect coolers. It also causes stoppages or impairs the flow of the liquor through the primary coolers. Therefore, this deposition has an adverse effect on the efficiency of cooling the gas, efficiency of naphthalene removal from the gas, efficiency of ammonia removal at the ammonia scrubbers, as well as the efficiency of light oil recovery.

In the prior art, there are many processes for more efficient removal of naphthalene from coke oven gas. Examples of these include the following U.S. Pat. Nos.: 2,710,663 (Wilson); 2,810,450 (Hartman); 3,000,693 (Schulte); and 4,001,347 (Grosick). These processes deal with naphthalene removal further downstream from the primary cooler for the gas and indirect cooler for the ammonia liquor, e.g., in the naphthalene scrubber and final cooler. These processes do not show a solution to the problem of naphthalene deposition in the indirect coolers which cool the ammonia liquor after it leaves the primary cooler, and before it is returned to the primary cooler to cool more coke oven gas.

A past remedy to prevent deposition of naphthalene on the cooling surfaces of the indirect coolers has been to add a mixture of light and heavy tar, sometimes referred to as production tar, which is collected in the flushing liquor decanter, to the ammonia liquor after the primary cooler and before the indirect ammonia liquor coolers to aid in dissolving the naphthalene that deposits on the cooling surfaces of the indirect cooler.

Unfortunately, modern coal mining methods are inclined to produce a coal that has a high percentage of extremely fine particles which escape from the battery of ovens with the coke oven gas and deposit in the tar in the flushing liquor decanter, resulting in a production tar that is high in quinoline insolubles. These insolubles exacerbate the separation of the tar from the liquor in the flushing liquor decanter and add to the deposition on liquor side surfaces of the indirect ammonia liquor coolers of the primary cooler. The amount of this tar that reaches the indirect cooler causes a sticky buildup of material that occludes to a degree the openings of the cooler. Because of the deposition of the quinoline insolubles or naphthalene or other compounds in the indirect cooler, it becomes necessary sometimes to restrict the flow of cooling waters to the indirect coolers or to temper the cooling water and thereby raise the temperature of the ammonia liquor leaving the indirect coolers and entering the primary coolers and, therefore, not cool the coke oven gas as much as desired. This production tar was preferred in the past because it had a low naphthalene content and it tended to prevent naphthalene deposition on the cooling surfaces in the cooler. But the practice of adding the low naphthalene, high quinoline insoluble tar to the ammonia liquor is so detrimental to the operation of the indirect coolers that the tar must be added to the liquor going to the primary cooler at some point after the indirect cooler. Such an addition is not the most facile or efficient manner for preventing the deposition of naphthalene and other materials in the indirect coolers for the ammonia liquor.

It is an object of the present invention to provide a process for minimizing the deposition of materials in an indirect cooler wherein ammonia liquor used to cool the coke oven gas is cooled before it is recycled to cool more coke oven gas.

An additional object of the invention is to maximize the efficiency of naphthalene removal, ammonia removal and light oil recovery in a coke oven by-product process by providing a process for effective cooling of the coke oven gas at the primary cooler.

A further object of the present invention is to provide a process to allow the most efficient use of an indirect cooler used to cool ammonia liquor that is used to cool coke oven gas.

SUMMARY OF THE INVENTION

In accordance with the present invention, a process is provided to minimize the depositions within the indirect cooler used to cool ammonia liquor from a cooling step for coke oven gas and to maximize the efficiency of naphthalene removal, ammonia removal and light oil recovery from coke oven gas.

The process of the present invention comprises adding light oil to the ammonia liquor that has been used to cool coke oven gas before the ammonia liquor enters an indirect cooler, where it is cooled for recycle to cool coke oven gas, in order to dilute traces of tar present in the liquor and lower the naphthalene content in the traces of tar to prevent deposition of naphthalene and tar in the indirect coolers.

The term "flushing liquor" means an aqueous solution (primarily the water condensing from the gas) of ammonia salts of which there are two kinds—free and fixed. The free salts are those which are decomposed on boiling to liberate ammonia. The fixed salts are those which require boiling with an alkali such as lime to liberate the ammonia.

The term "ammonia liquor" refers to the water vapor that condenses in the primary cooler containing very little fixed ammonia such as ammonium chloride and ammonium sulfate, and containing substantial quantities of free ammonia such as ammonium hydrosulfide, ammonium carbonate and ammonium cyanide in solution.

The term "light oil" refers to a clear, yellow-brown oil somewhat lighter than water. It contains varying amounts of coal gas products with boiling points from about 40° C. to 200° C., with benzene, toluene, xylene and solvent naphthas being the principal constituents. This light oil is a powerful solvent for naphthalene, being capable of dissolving about 78 pounds of naphthalene per 100 pounds of light oil at 30° C.

The meaning of the term "heavy tar" is higher specific gravity and higher molecular weight organic matter that separates by condensation from the coke oven gas in the collecting mains, is collected with the flushing liquor at the downcomer upstream of the final cooler and flows to the flushing liquor decanting tank.

The meaning of the term "light tar" is organic matter with lower average specific gravity and lower average molecular weight than those in heavy tar and separates from the gas substantially in the primary coolers by condensation, with lesser quantities being removed mechanically at exhausters and tar precipitators for final cleaning of the gas with respect to tar.

Both tars may be added together in the flushing liquor decanter to produce a composite tar called production tar.

Production tar is a black viscous liquid a little heavier than water. The following general classes of compounds may be recovered from production tar: pyridine, tar acids, naphthalene, creosote oil and coal tar pitch, with lesser quantities of many other organic compounds, including some free carbon.

BRIEF DESCRIPTION OF THE DRAWINGS

For a better understanding of my invention, its objects and advantages, reference should be had to the accompanying drawings in which.

DETAILED DESCRIPTION OF THE INVENTION

Figure 1:
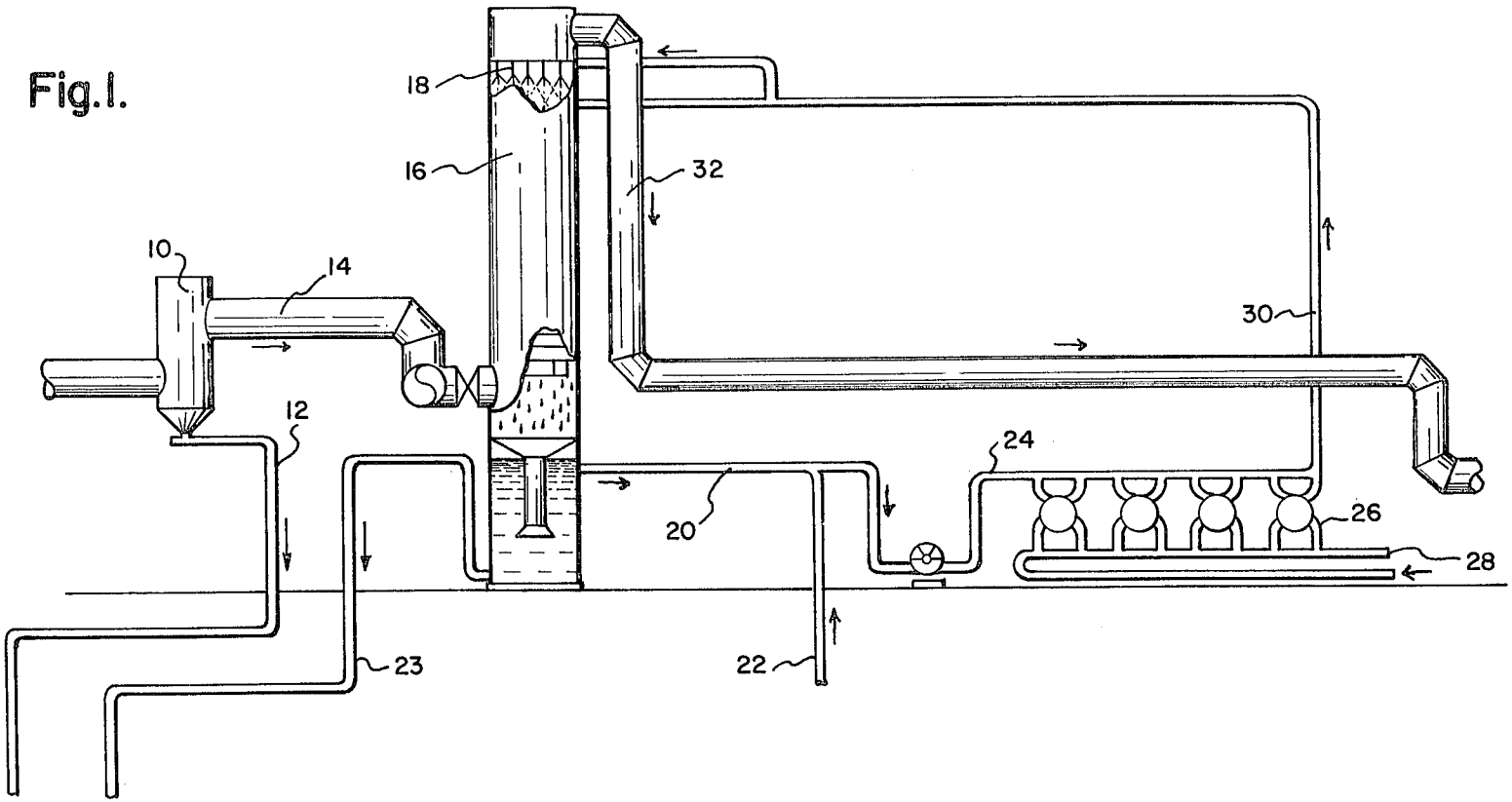
FIG. 1 is a schematic flowsheet of my process for adding light oil to the ammonia liquor coming from a coke oven gas cooling step.

Referring to FIG. 1 of the drawings, numeral 10 designates any conventional downcomer from the collecting mains of any conventional battery of coke ovens. A mixture of flushing liquor, gas, and tar flows through the downcomer 10 where the gases separate from the liquor and heavy tar. The liquor and heavy tar flow through line 12 to the decanter tank (not shown) where the tar, being heavier than the liquor, settles to the bottom of the decanter and is pumped in a conventional manner to storage. The flushing liquor is collected and recirculated to the collecting main. The excess of flushing liquor formed is pumped to a flushing liquor storage tank.

The gas flows through line 14 from the downcomer to the lower section of a conventional primary cooler 16 and ascends therethrough countercurrent to the liquid descending from the sprays 18. The liquor for the sprays 18 collects in the lower portion of the primary cooler and flows through line 20.

Almost all of the light tar that condenses out of the gas in primary cooler 16 accumulates with the ammonia liquor in the base of the primary cooler. The tar, being heavier than water, settles to the bottom of the reservoir with the upper layer being almost totally aqueous ammonia liquor. The light tar and excess ammonia liquor flow from the reservoir through line 23 to the flushing liquor decanter where the light tar mixes with the heavy tar to form production tar, and the ammonia liquor mixes with the flushing liquor.

Light oil is added to the liquor in line 20 by line 22. The light oil can be added in any amount, but high amounts would not be economically advantageous since the light oil will have to be removed eventually from the liquor. Small amounts of the light oil can be added to the liquor since even small amounts will aid in preventing some deposition of materials in the indirect coolers 26. The light oil is a typical light oil produced from any conventional coke oven gas. The addition of the light oil dilutes traces of light tar present in the ammonia liquor flowing from the primary cooler through indirect coolers 26 and, therefore, lowers the naphthalene content in the traces of tar in suspension in the ammonia liquor.

The liquor diluted with light oil flows through line 24 and into indirect cooler 26. The indirect cooler may be a single or a battery of either shell-and-tube heat exchangers or spiral heat exchangers. The cooling medium, usually water, is conveyed to the indirect coolers by line 28. Depending on the water balance of the operation, the cooling water can be either once-through service water or recirculated water. When recirculated water is used, the heat is removed from the heated water by evaporative cooling. Any make-up water that is needed can be added to the indirect cooler.

The presence of the light oil in the liquor dilutes the light tar in the ammonia liquor that contains naphthalene and reduces or prevents the deposition of napthalene and tar on the ammonia liquor side cooling surfaces of the cooler 26. This permits greater quantities of cooling water to be circulated on the water sides of the coolers 26 which in turn permits the circulating liquor in line 30, leaving the coolers to be cooled down as low as 30° C. or lower. This enables more effective cooling and more effective light tar and naphthalene removal in the primary cooler 16 without causing naphthalene and/or tar deposition on the surfaces of the liquor side cooling surfaces of coolers 26. Also, if the primary cooler is the indirect type, the addition of light oil also aids in reducing or preventing the deposition of naphthalene in the last section on the cooler end of the indirect heat exchanger in the primary cooler.

The cooled ammonia liquor leaving the coolers 26 by line 30 is conveyed to the top of primary cooler 16 through sprays 18. The ammonia liquor contacts more coke oven gas in the primary cooler to produce more condensates. Also, the primary cooler can have a secondary or respray section and pumping section (not shown in FIG. 1). The cool ammonia liquor is collected at the end of the primary spray section, a distance down the primary cooler from the primary sprays 18, and the collected ammonia liquor is recirculated to another set of sprays below the primary sprayers in the primary spray section. Any uncondensed gas leaves the primary cooler 16 through line 32 for further processing.

DESCRIPTION OF THE PREFERRED EMBODIMENT OF THE INVENTION

Figure 2:
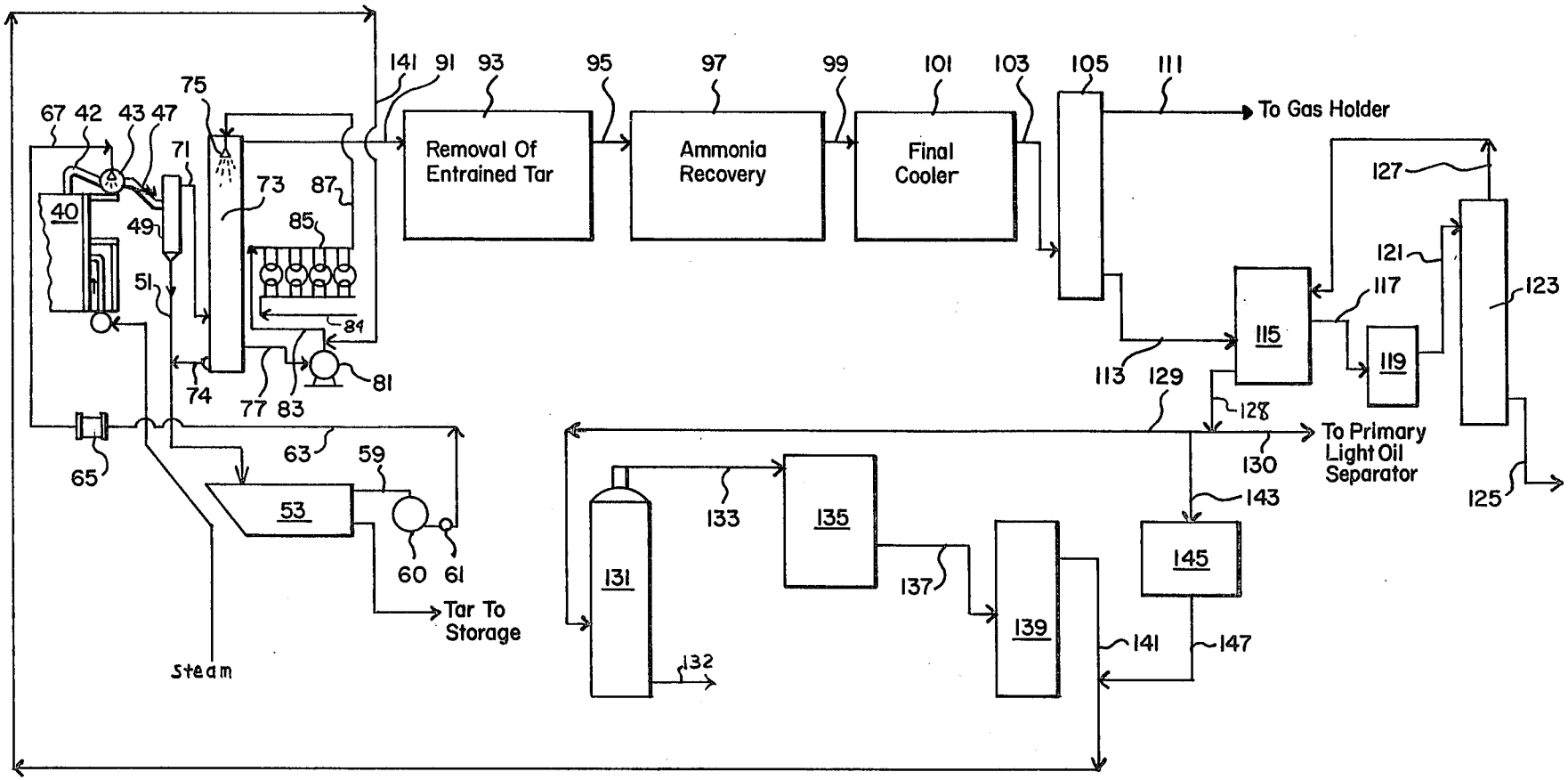
FIG. 2 is a schematic flowsheet of the preferred embodiment of my integrated process for adding light oil produced from coke oven gas to the ammonia liquor recovered from the primary cooler to minimize the deposition of material in the indirect coolers.

Referring to FIG. 2, coal or other bituminous material are heated in a conventional coke oven battery 40 in the absence of air. The gas evolved flows through line 42 to a collector main 43. Flushing liquor is sprayed into the line 42 and collector main 43 though injectors (now shown), cooling the hot gases and condensing some of the tars. The mixture of flushing liquor, gas, and tar flows through line 47 to a downcomer 49 where the gases separate from the liquor and tar.

The liquor and tar flow through a line 51, from downcomer 49, to a flushing liquor decanter tank 53, where the tar settles to the bottom and either flows by gravity or is pumped in a conventional manner to storage. The flushing liquor flows through line 59 to a circulating tank 60 and is forced by a pump 61, through line 63, screen 65, and line 67 to the collecting main 43.

The gas flows through line 71 from downcomer 49, to the lower section of primary cooler 73, and ascends therethrough countercurrent to the liquid descending from the sprays 75. The ammonia liquor from sprays 75 collects in the lower portion of the primary cooler 73, where it separates from the light tar. The light tar is removed from the primary cooler 73 by line 74 to be combined with liquor and tar in line 51 that are conveyed to the flushing liquor decanter tank 53. The aqueous ammonia liquor flows through a line 77 to a pump 81 which circulates the liquor through line 83.

Into line 83 light oil is introduced by line 141 from the light oil production part of the process. The preferred amount of light oil added is less than about fifty percent (50%) by volume of the light oil produced by the carbonization of coal and recovered in the by-product process. The introduction of this light oil into the ammonia liquor minimizes any deposits of naphthalene which are present in the small amounts of light tar in the ammonia liquor and any deposits of tar from the ammonia liquor when the liquor passes through the indirect cooler 85. In an alternative embodiment the addition of the light oil can be made at conduit 77 before pump 81 to improve the mixing of the light oil with the traces of light tar in suspension in the ammonia liquor.

The minimizing of deposits in cooler 85 permits greater quantities of cooling water to be circulated on the water sides of the coolers 85 by line 84. This permits the circulating ammonia liquor that is recycled to the primary cooler to be cooled down to 30° C. or lower to obtain more effective cooling and more effective light tar and naphthalene removal in the primary cooler. The indirect cooler 85 may be any conventional heat exchanger or battery of heat exchangers, but preferably is a battery of shell-and-tube heat exchangers or, alternatively, spiral heat exchangers. The cooled ammonia liquor leaves cooler 85 by line 87 and is conveyed to sprays 75 to cool more coke oven gas. The ammonia liquor used to cool the coke oven gas in the primary cooler is ammonia liquor that has been condensed from the coke oven gas produced in the carbonization of coal.

The gas leaves the primary cooler adjacent to the upper end thereof through line 91 and undergoes further processing. The gas leaving the primary cooler still contains small amounts of tar that would cause difficulty in the operation of subsequent units in the recovery system. The gas is treated for removal of the entrained tar in zone 93, which is preferably an exhauster and an electrostatic precipitator. After the tar removal zone, the gas flows into an ammonia removal and recovery zone 97 by line 95. This recovery zone may be preceded by a naphthalene scrubbing zone, if the ammonia is recovered by an aqueous method. The ammonia may be recovered in zone 97 by the indirect or semi-direct process, but preferably the indirect process is used with one or more ammonia scrubbers that utilize water. After the ammonia has been recovered, the liquor produced may contain phenol in varying quantities, which may be recovered, and may contain various ammonium compounds (not shown in FIG. 2).

The gas leaves the ammonia recovery zone and, if necessary, is conveyed to a final cooler 101 by line 99 to be cooled to a temperature around 75° to 85° F. (23.8° C. to 29.4° C.) for efficient light oil recovery. After the gas has been cooled in the final cooler, it is treated to recover light oil.

The gas from the final cooler is conveyed by line 103 to the light oil scrubber 105, where the gas comes in contact with absorbent oil. The gas which leaves scrubber 105 at line 111 is substantially free of soluble by-products such as tar, naphthalene, ammonia and light oil. This gas may then flow to a suitable gas holder or to a consumer for the production of chemicals, such as synthetic ammonia, or to a steel plant as fuel. The light oil scrubber may have four or more stages to enhance the absorption by the absorbent oil of the light oil, i.e., the benzene, toluene, xylene components of the coke oven gas.

The oil from the base of the light oil scrubber, now called benzolized wash oil, is removed from the light oil scrubber by line 113 and is pumped through heat exchanger 115 where it is heated by the vapors from the wash oil still 123. The heated oil is conveyed by line 117 to a final heater 119 where it is heated further to a temperature around 250° F. (121° C.).

The heated oil is conveyed by line 121 to the top of wash oil still 123 where benzene, toluene, xylene and numerous other organic compounds in minor amounts that have been absorbed in the oil is vaporized. The stripped or debenzolized wash oil is conveyed from the wash oil still by line 125 and is used after cooling for recycle to the light oil scrubber 105.

The mixture of steam stripped light oil and water vapors from the top of the still 123 enters the vapor-to-oil heat exchanger 115 by line 127 from the wash oil still. In giving up heat to the entering oil, most of the steam condenses with a small quantity of oil. This oil condensate, primary light oil, consists mainly of condensed wash oil vapors and is conveyed by line 128 and line 130 to a primary light oil separator (not shown in FIG. 2) to separate the oil from water. After separation from the water, the oil is added to the benzolized wash oil going to the vapor-to-oil heat exchanger (not shown in FIG. 2). The uncondensed vapors from the heat exchanger 115 are conveyed by lines 128 and 129 to the light oil rectifier 131, where the light oil is separated into two fractions, one a liquid called intermediate light oil containing the heavier fractions, and the other a vapor containing benzene, toluene, xylene and steam. The intermediate light oil fraction leaves rectifier 131 by line 132 and can be recovered and sold or further distilled. The vapor fraction is conveyed by line 133 from the light oil rectifier to the light oil condenser 135, where the vapor fraction is condensed. Then the water is separated from the oil in the secondary light oil separator 139 to which the condensed oil has been conveyed from the condenser by line 137. The oily portion, called rectified secondary light oil and rich in benzene, toluene and xylene and low in naphthalene, is conveyed by line 141 from the rectified secondary light oil separator 139 to ammonia liquor line 83 or, alternatively, line 77 to dissolve naphthalene in indirect ammonia liquor coolers 85.

An alternative is to condense a portion of the crude light oil vapors leaving heat exchanger 115 in lines 128 and 129 by diverting a portion of the vapors to line 143 to be condensed in condenser 143 and add up to 50 percent by volume of the oil portion of condenser 145 to line 141 by line 147 to carry it to line 77 or 83 to dissolve naphthalene in indirect ammonia liquor coolers 85. The latter oil would have a slightly lower dissolving capacity for naphthalene since it, unlike rectified light oil from condenser 135, contains a small amount of naphthalene. Alternatively, secondary light oil can be sent to storage and pumped from storage into line 141.

The quantity of secondary light oil in line 141 is preferably less than 50 percent by volume of the secondary light oil produced. This amount is preferred in order to provide the amount of light oil necessary to prevent the deposition of materials in the ammonia liquor coolers while not providing too great an amount that must eventually be removed from the liquor and recovered from the gas leaving the primary cooler.

The light oil added to ammonia liquor line 77 or 83 upstream of indirect coolers 85 after it has mixed thoroughly with the flowing ammonia liquor stream dilutes the traces of light tar in suspension therein and lowers the crystallizing temperature for naphthalene on the ammonia liquor side cooling surfaces of indirect coolers 85 before being conducted as a liquid suspension of oil in ammonia liquor through line 87 to and through sprays 75 in primary cooler 73. The mixture, upon being sprayed through sprays 75 into the top of primary cooler 73, comes into intimate contact with the gas being cooled in primary cooler 73. The cooling of the gas condenses light tar and naphthalene which are washed into the ammonia liquor reservoir in the base of primary cooler 73. The light oil which had been transported from light oil recovery step through line 141, being quite volatile, is reevaporated into the gas stream in the top portion of primary cooler 73 to be conveyed with the gas stream through the purifying equipment back to the light oil scrubber 105 to be re-removed and subsequently re-recovered along with removal and recovery of newer light oil constituents contained in the more recently produced gas.

In the process of the present invention, the naphthalene content in the gas entering the primary cooler may be so high that naphthalene may come out of solution in the light tar layer in the reservoir of the primary cooler. In other words, a saturated solution of naphthalene in the light tar layer may exist in the reservoir. To overcome this, it is preferred to add production tar having a much lower naphthalene content than light tar condensed in the primary cooler to the primary cooler. This addition may occur either directly to the top of the primary cooler or to the downstream side of the ammonia liquor coolers 85. When this tar enters the primary cooler through sprays at the top of the primary cooler 73, it dilutes the primary cooler tar condensed therein with respect to naphthalene and prevents crystallization of naphthalene out of the tar layer in the reservoir of the primary cooler. The production tar is a mixture of light and heavy tar collected in the flushing liquor decanter tank 53 in FIG. 2. The amount of production tar added is up to about 10 gallons per 10,000 cubic feet of gas passing through primary cooler 73. This addition of production tar is done in addition to the addition of light oil to the ammonia liquor upstream of the indirect ammonia liquor coolers 85.

It is clear that the process of the present invention can and normally does comprise the use of several additional parts, such as various valves, gauges, pressure-regulating devices and/or others, which are omitted for the sake of clarity. It is also clear that the operations of the various zones referred to above can be performed in any manner known to those skilled in the art for accomplishing the stated purpose of the particular zone.

The foregoing has described a process for minimizing the deposition of naphthalene and tar in the ammonia liquor coolers of a by-product recovery process for the coking of coal. It will be clear to those skilled in the art that the novel improved process of the present invention involves the use of various equipment such as coke oven battery, decanter tank, primary cooler, ammonia liquor coolers, wash oil stills, and light oil recovery equipment that are conventional units for the coking of coal and the recovery of by-products from the gases evolved during the coking.

I claim:

1. An improved process for cooling coke oven gas in the primary cooler of a coke oven gas by-product recovery process comprising contacting the coke oven gas in the primary cooler with ammonia liquor, passing the ammonia liquor coming from the primary cooler through an indirect ammonia liquor cooler and recycling the cooled ammonia liquor to the primary cooler wherein the improvement comprises adding light oil having boiling points from about 40° to 200° C. to the ammonia liquor after it has left the primary cooler but before it enters the indirect ammonia liquor cooler.

2. A process as in claim 1 wherein production tar is added to the primary cooler to minimize the deposition of naphthalene in the reservoir of the primary cooler.

3. A process as in claim 1 wherein the light oil added to the ammonia liquor is sprayed into the primary cooler with the ammonia liquor and evaporates into the gas stream leaving the primary cooler, and is removed from the gas and recovered for recycle for addition to the ammonia liquor.

4. A process as in claim 1 wherein a portion of crude light oil is combined with light oil and recycled for addition to ammonia liquor.

5. A process as in claim 1 wherein the light oil is secondary light oil recovered as a by-product in the by-product recovery process.

6. A process as in claim 5 wherein less than one-half of the light oil recovered is added to the ammonia liquor.

* * * * *